United States Patent [19]

Aurensan

[11] 4,377,045

[45] Mar. 22, 1983

[54] IRONING PRESS

[75] Inventor: Jean-Claude A. Aurensan, Bernieres-sur-Mer, France

[73] Assignee: Moulinex, SA, Bagnolet, France

[21] Appl. No.: 237,734

[22] Filed: Feb. 24, 1981

[30] Foreign Application Priority Data

Feb. 29, 1980 [FR] France ..... 80 04548

[51] Int. Cl.[3] ..... D06F 69/02; D06F 71/00

[52] U.S. Cl. ..... 38/11; 38/18

[58] Field of Search ..... 38/8–11, 38/63, 64, 66, 17, 18, 68; 100/153, 222

[56] References Cited

U.S. PATENT DOCUMENTS 2,686,377 8/1954 Case ..... 38/11

FOREIGN PATENT DOCUMENTS 2040601 10/1971 Fed. Rep. of Germany ..... 38/11

*Primary Examiner*—Louis Rimrodt

*Attorney, Agent, or Firm*—Young & Thompson

[57] ABSTRACT

An ironing press includes an ironing table equipped with an endless conveyor belt mounted on two spaced parallel rollers and a drive for rotating one of the rollers to drive the belt. For an ironing operation, a heatable pressing plate is moved near to the ironing table. In order to enable the conveyor belt to have sufficient strength and inextensibility to be driven by the rollers and yet provide a suitable ironing surface the conveyor belt is made up of a drive belt carrying a cushion and a textile covering enclosing the outer surface of the cushion. Friction between the cushion and the covering acts to drive the covering with the drive belt.

6 Claims, 5 Drawing Figures

Fig 1
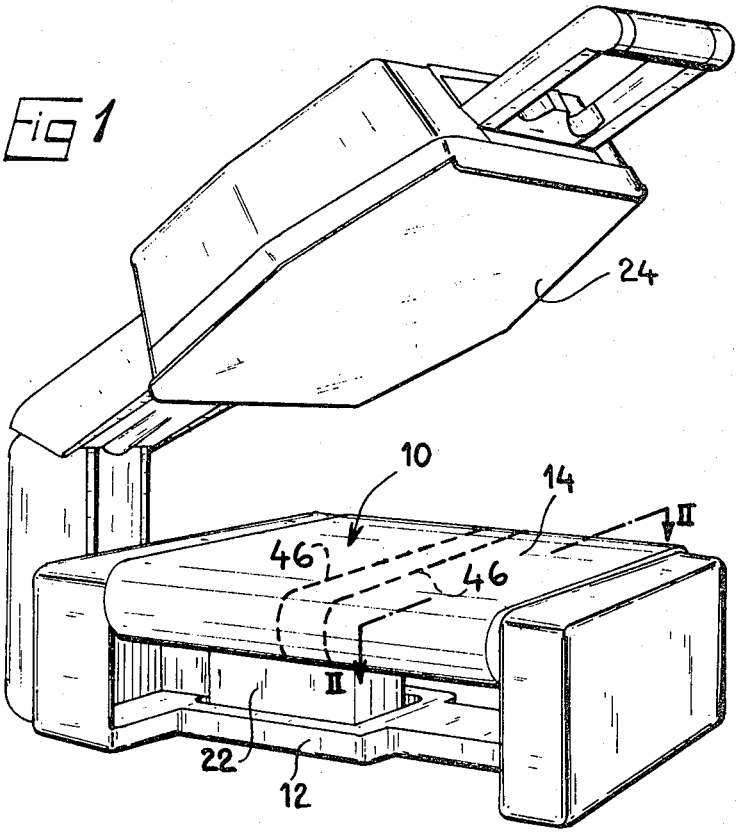
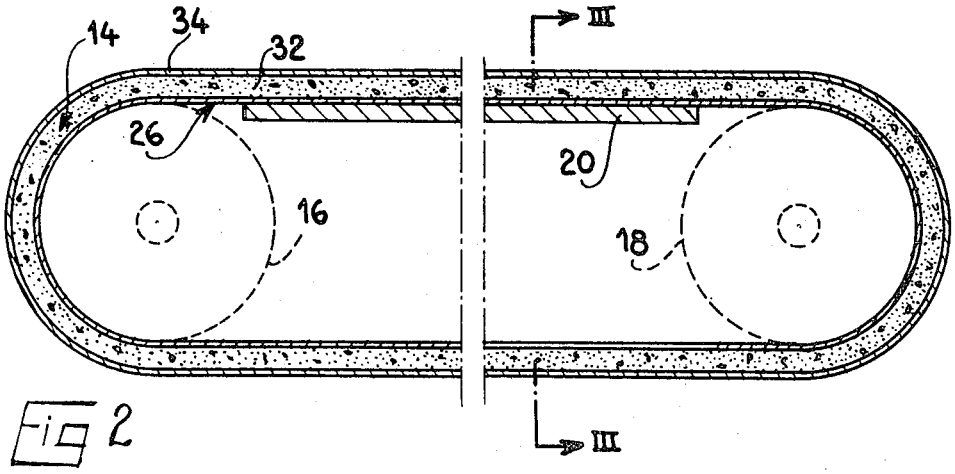
Fig 2

IRONING PRESS

BACKGROUND TO THE INVENTION

The invention relates to ironing presses of the type comprising an ironing table equipped with an endless conveyor belt mounted on two spaced parallel rollers, drive means arranged to rotate at least one of the rollers, and a heatable pressing plate arranged to be moved near to the ironing table for an ironing operation.

It will be appreciated that in an ironing press of this type the conveyor belt must have an inner surface having strength and inextensibility properties suitable for being driven by means of rollers, and must have an outer surface possessing flexibility similar to that of ironing cloths for domestic use, as well as elasticity enabling it to absorb alternating compressive and tensile stresses occurring respectively in the rectilinear and curved zones of the path of travel of the belt.

It is an object of the invention to provide a conveyor belt for use in an ironing press which complies with these contradictory requirements.

SUMMARY OF THE INVENTION

According to the present invention there is provided an ironing press comprising an ironing table, a heatable pressing plate arranged to be moved near to the ironing table for an ironing operation, two spaced parallel rollers supported by said table, an endless conveyor belt supported on said spaced rollers, and drive means arranged to rotate at least one of said rollers to drive the conveyor belt, wherein the conveyor belt comprises a drive belt having an inner surface in engagement with said rollers, a flexible cushion carried on the outer surface of the drive belt, and an endless textile covering enclosing the outer surface of the flexible cushion, the textile covering being arranged to be driven by the cushion by friction between the outer surface of the cushion and the inner surface of the covering.

The conveyor belt of the invention allows some slipping of the covering with respect to the drive belt in the direction of travel. In practice, the conveyor belt giving excellent results.

BRIEF DESCRIPTION OF THE DRAWINGS

An embodiment of the present invention will hereinafter be described, by way of example, with reference to the accompanying drawings, in which:

FIG. 1 shows a perspective view of a domestic ironing press;

FIG. 2 is a vertical section on a larger scale, taken on the line II—II of FIG. 1, of the conveyor belt with the rollers shown schematically in broken lines;

DESCRIPTION OF A PREFERRED EMBODIMENT

Figure 3:
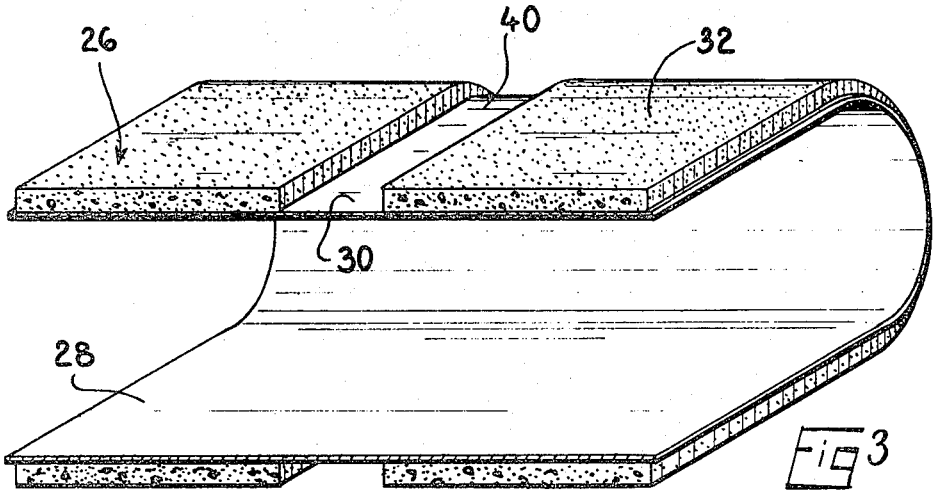
FIG. 3 shows a sectioned perspective view of a drive belt forming part of the conveyor belt, the section being taken on line III—III of FIG. 2.

The ironing press illustrated is of the type described above and comprises an ironing table 10 supported by a base 12 and equipped with an endless conveyor belt 14. The belt 14 is mounted on two rollers 16 and 18 which are spaced apart from one another and have parallel axes. The belt 14 slides on a flat fixed support 20 disposed between the rollers 16 and 18 (FIG. 2).

The roller 16 is rotated by way of a drive unit 22. The press also includes a heated pressing plate 24 which is brought close to the table 10 for the ironing operation, as described in the aforesaid French Patent Application.

Figure 4:
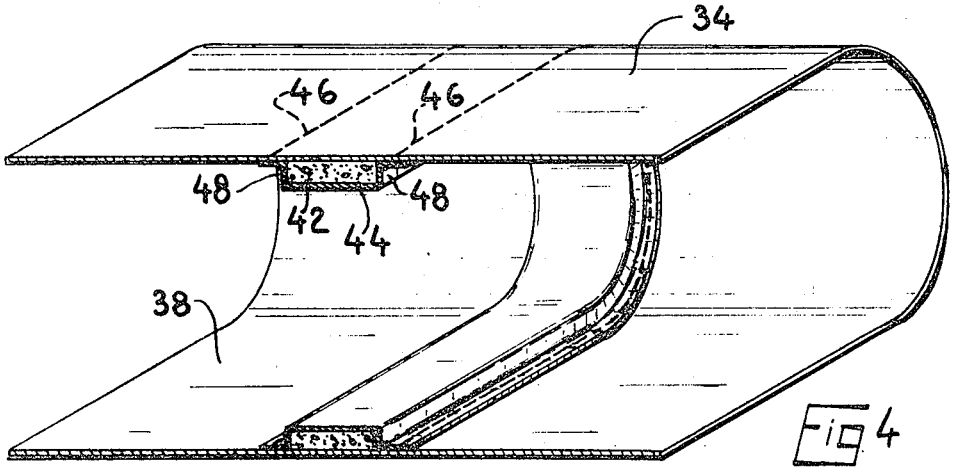
FIG. 4 shows a sectioned perspective view of a textile covering enclosing the drive belt, the section also being taken on line III—III of FIG. 2.
Figure 5:
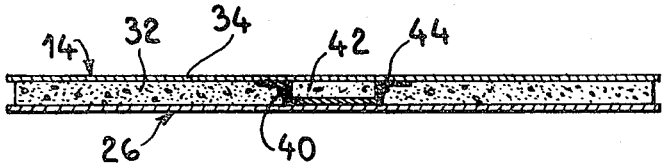
FIG. 5 is a vertical section of the upper side of the conveyor belt.

The conveyor belt 14 comprises an endless drive belt 26 (FIG. 3), of which one surface 28 is in engagement with the rollers 16 and 18. The other surface 30 of the drive belt 26 carries a flexible endless cushion 32. An endless textile covering 34 (FIG. 4) covers the outer surface of the cushion 32 (FIGS. 2 and 5). The covering 34 is driven by the cushion by the action of friction between the outer surface of the cushion 32 and the inner surface 38 of the covering 34.

The drive belt 26 is made of a strong material having very slight extensibility, such as, for example, a urethane-coated polyester fabric, or rubber reinforced with fibreglass cords. The cushion 32 is composed, for example, of a flexible organic foam material, such as polyurethane. The textile covering 34 consists of an aromatic polyamide fibre fabric, resistant to high temperature, such as that sold by Dupont de Nemours under the name "NOMEX" (Registered Trademark).

In order to avoid any accidental displacement of the covering 34 in relation to the drive belt 26 in the direction of the axis of the rollers, the drive belt and the covering are provided with mutual alignment means arranged to bring the median longitudinal plane of the covering 34 into coincidence with the median longitudinal plane of the drive belt 26. As illustrated in FIGS. 3 to 5, these alignment means comprise an endless slide 40 provided on the drive belt 26 parallel to its median longitudinal plane, and an endless pad 42 carried by the covering 34 and fitting into the slide 40. The slide 40 is in the form of a groove made in the cushion 32 along the median longitudinal plane of the drive belt, whilst the pad 42 is in the form of a matching rib carried by the inner surface 38 of the covering 34 and formed by a strip of polyurethane foam joined to the covering by a tape 44 of said NOMEX straddling the strip and joined to the covering by two seams 46 sewn on the edges of the tape. The groove 40 is preferably composed of a wide trench leaving bare a central zone of the material forming the drive belt 26. The median region of the outer face of the tape 44 comes to bear against this zone.

It will be understood that in the conveyor belt thus constituted a certain slipping of the covering in relation to the belt, in the direction in which the belt is driven, is permitted. When this slipping takes place, the median region of the tape 44 is displaced on the bottom of the groove 40. The vertical portions 48 of this tape prevent any harmful direct rubbing between the pieces of foam forming the cushion 32 and the pad 42.

I claim:

1. An ironing press comprising an ironing table, a heatable pressing plate arranged to be moved near to the ironing table for an ironing operation, two spaced parallel rollers supported by said table, an endless conveyor belt supported on said spaced rollers, and drive means arranged to rotate at least one of said rollers to drive the conveyor belt, the conveyor belt comprising a drive belt having an inner surface in engagement with said rollers, a flexible cushion carried on the outer surface of the drive belt, and an endless textile covering enclosing the outer surface of the flexible cushion, the textile covering being arranged to be driven by the cushion by friction between the outer surface of the cushion and the inner surface of the covering, and mutual alignment means arranged to bring the median longitudinal plane of said covering into coincidence with the median longitudinal plane of said drive belt.

2. A press according to claim 1, wherein said mutual alignment means comprise an endless slide provided on the drive belt parallel to its median longitudinal plane, and at least one pad carried by the covering and fitting into the slide.

3. A press according to claim 2, wherein said slide is in the form of a groove in the cushion extending along the median longitudinal plane of the drive belt, and said pad is in the form of a corresponding rib carried by the inner surface of the covering.

4. A press according to claim 3, wherein the cushion is made of a flexible organic foam material and the rib is formed of a strip made of the same foam material and joined to the covering.

5. A press according to claim 4, wherein both the cushion and the rib are made of polyurethane.

6. A press according to claim 4 or claim 5, wherein the strip forming the rib is joined to the covering by a fabric tape straddling said strip and sewn at its edges to the covering.

* * * * *